US007990282B2

(12) United States Patent
Huang et al.

(10) Patent No.: US 7,990,282 B2
(45) Date of Patent: Aug. 2, 2011

(54) BOREHOLE TELEMETRY SYSTEM

(75) Inventors: Songming Huang, Hardwick (GB); Franck Monmont, Caldecote (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 1156 days.

(21) Appl. No.: 10/569,514

(22) PCT Filed: Aug. 23, 2004

(86) PCT No.: PCT/GB2004/003597

§ 371 (c)(1), (2), (4) Date: Apr. 2, 2007

(87) PCT Pub. No.: WO2005/024182

PCT Pub. Date: Mar. 17, 2005

(65) Prior Publication Data

US 2007/0227776 A1 Oct. 4, 2007

(30) Foreign Application Priority Data

Sep. 5, 2003 (GB) ..... 0320804.8

(51) Int. Cl.
*G01V 3/00* (2006.01)

(52) U.S. Cl. ..... 340/854.4; 340/854.3; 367/82; 367/83; 175/40; 175/45

(58) Field of Classification Search ..... 340/853.3, 340/854.3–854.4; 367/82–83; 175/40, 45
See application file for complete search history.

(56) References Cited

U.S. PATENT DOCUMENTS

| | | | |
|---|---|---|---|
| 3,659,259 | A | 4/1972 | Chaney, Jr. et al. |
| 3,789,355 | A | 1/1974 | Patton |
| 3,964,556 | A | 6/1976 | Gearhart et al. |
| 5,283,768 | A | 2/1994 | Rorden |
| 5,839,508 | A | 11/1998 | Tubel et al. |
| 5,924,499 | A | 7/1999 | Birchak et al. |
| 6,172,614 | B1 | 1/2001 | Robison et al. |
| 6,442,105 | B1 | 8/2002 | Tubel et al. |
| 2003/0026167 | A1 | 2/2003 | Hahn et al. |
| 2003/0086336 | A1 | 5/2003 | Dubinsky |
| 2003/0116969 | A1 | 6/2003 | Skinner et al. |

FOREIGN PATENT DOCUMENTS

| | | | |
|---|---|---|---|
| EP | 0 685 628 | A1 | 12/1995 |
| EP | 1 302 624 | A1 | 4/2003 |
| GB | 2 343 537 | A | 5/2000 |
| GB | 2 348 029 | A | 9/2000 |
| GB | 2 399 921 | A | 9/2004 |
| WO | 96/09561 | A1 | 3/1996 |
| WO | 02/27139 | A1 | 4/2002 |
| WO | 03/067029 | A1 | 8/2003 |
| WO | 2005/024177 | A1 | 3/2005 |

*Primary Examiner* — Albert K Wong

(74) *Attorney, Agent, or Firm* — Helene Raybaud; Brigid Laffey

(57) ABSTRACT

An acoustic telemetry apparatus and methods for communicating digital data from a down-hole location through a borehole to the surface or between locations within the borehole are described including a receiver and a transmitter linked by an acoustic channel (210) wherein acoustic channel has a cross-sectional area of 58 $cm^2$ or less and the transmitter comprises an electro-active transducer generating a modulated continuous waveform.

34 Claims, 5 Drawing Sheets

BOREHOLE TELEMETRY SYSTEM

CROSS-REFERENCE TO RELATED APPLICATIONS

This application claims the benefits of priority from:

i) Application Number 0320804.8, entitled "BOREHOLE TELEMETRY SYSTEM," filed in the United Kingdom on Sep. 5, 2003; and ii) Application Number PCT/GB2004/003597, entitled "BOREHOLE TELEMETRY SYSTEM," filed under the PCT on Aug. 23, 2004;

All of which are commonly assigned to assignee of the present invention and hereby incorporated by reference in their entirety.

The present invention generally relates to an apparatus and a method for communicating parameters relating to down-hole conditions to the surface. More specifically, it pertains to such an apparatus and method for acoustic communication.

BACKGROUND OF THE INVENTION

One of the more difficult problems associated with any borehole is to communicate measured data between one or more locations down a borehole and the surface, or between down-hole locations themselves. For example, communication is desired by the oil industry to retrieve, at the surface, data generated down-hole during operations such as perforating, fracturing, and drill stem or well testing; and during production operations such as reservoir evaluation testing, pressure and temperature monitoring. Communication is also desired to transmit intelligence from the surface to down-hole tools or instruments to effect, control or modify operations or parameters.

Accurate and reliable down-hole communication is particularly important when complex data comprising a set of measurements or instructions is to be communicated, i.e., when more than a single measurement or a simple trigger signal has to be communicated. For the transmission of complex data it is often desirable to communicate encoded digital signals.

One approach which has been widely considered for borehole communication is to use a direct wire connection between the surface and the down-hole location(s). Communication then can be made by wire-bound electrical signals. While much effort has been spent on "wireline" communication, its inherent high telemetry rate is not always needed and very often does not justify its high cost.

Another borehole communication technique that has been explored is the transmission of acoustic waves. Whereas in some cases the pipes and tubulars within the well can be used to transmit acoustic waves, commercially available systems utilize the various liquids within a borehole as the transmission medium.

Among those techniques that use liquids as medium are the well-established Measurement-While-Drilling or MWD techniques. A common element of the MWD and related methods is the use of a flowing medium, e.g., the drilling fluids pumped during the drilling operation. This requirement however prevents the use of MWD techniques in operations during which a flowing medium is not available.

In recognition of this limitation various systems of acoustic transmission in a liquid independent of movement have been put forward, for example in the U.S. Pat. No. 3,659,259; 3,964,556; 5,283,768 or 6,442,105. However none of these techniques are successfully applied to monitor borehole parameters and transmit data to the surface during production enhancing operation such as fracturing.

It is therefore an object of the present invention to provide an acoustic communication system that overcomes the limitations of existing devices to allow the communication of data between a down-hole location and a surface location.

SUMMARY OF THE INVENTION

In accordance with a first aspect of the invention, there is provided an acoustic telemetry apparatus for communicating digital data from a down-hole location through a borehole to the surface or between locations within the borehole. The apparatus includes a receiver and a transmitter linked by an acoustic channel wherein the acoustic channel has a cross-sectional area of 58 $cm^2$ or less and the transmitter comprises an electro-active transducer generating a modulated continuous waveform.

The acoustic channel preferably provides a low loss liquid medium for pressure wave propagation between the transmitter and the receiver.

The use of active down-hole sources for the purpose transmitting measured data to a surface location has been hampered in the past by the fact that the amount of energy required to successfully operate the source is relatively large. In most case it exceeds the energy that can be stored in batteries, capacitors and the like to the extent that these sources are suitable for use in the harsh and spatially restricted environment of a typical subterranean hydrocarbon reservoir.

The power needed to generate a pressure wave of required amplitude is given by $$\Delta P=(\rho c^2)\Delta V/V \quad [1]$$

where ρ is the density of the acoustic medium and c the speed of sound, V is the volume of the acoustic medium and ΔV is the variation of volume necessary to generate the pressure increment ΔP. Equation 1 means that for a large volume V, a large volume change ΔV is required to generate an appropriate pressure perturbation ΔP. In turn generating a large ΔV means that a large power source is needed. In cases where the liquid volume is large, i.e., when the whole annulus between a work string and the casing is used as the telemetry channel, the power drain on a down-hole source is considerable. For example for an annulus formed by a 7" casing (0.16 m inner diameter) and 3.5 tubing (0.09 m outer diameter), a 30 Hz piston source with a displacement of 1 mm (2 mm peak-to-peak) can generate a wave amplitude of about 3 bar with an acoustic power of around 270 W. Assuming a source efficiency of 0.5, then an electrical power of 540 W is required down-hole. This makes a battery powered down-hole source generally impractical.

The present example therefore makes use of acoustic channels with a small volume and, hence, a small cross-sectional area. This approach is however difficult as the attenuation in a tubular acoustic medium depends partly on its radius:

$$\alpha=(\mu\omega/(2\rho)^{0.5}/(cr) \quad [2]$$

where μ is the viscosity of the liquid, ω the angular frequency and r the inner radius of the tube. Given the wave frequency and the physical properties of the fluid, the tube radius r determines the signal attenuation. For communication through thin tubes, as proposed herein, the α value is large and the proper size of the tubes to be used as an acoustic channel is a matter of careful consideration and selection to avoid total loss of the signal before it reaches the surface location.

The new system allows communication of encoded data that may contain the results of more than one or two different types of measurements, such as pressure and temperature.

The cross-sectional diameter of the acoustic channel is 58 $cm^2$ or less, corresponding to a 3 inch (7.5 cm) diameter. More preferably, the cross-sectional diameter of the acoustic channel is 25 $cm^2$ or less corresponding to a 2 inch (5.64 cm) diameter.

The acoustic channel used for the present invention is preferably a continuous liquid-filled channel. Often it is preferable to use a low-loss acoustic medium, thus excluding the usual borehole fluids that are often highly viscous. Preferable media include liquids with viscosity of less than $3\times10^{-3}$ $NS/m^2$, such as water and light oils.

The acoustic channel may be implemented using a small-diameter continuous string of pipe, such as coiled tubing, lowered into the borehole prior to an intended well operation or, alternatively, by making use of permanently or quasi-permanently installed facilities such as hydraulic power lines.

In a preferred variant the apparatus may include an acoustic receiver at the down-hole location thus enabling a two-way communication.

The receiver of the telemetry system preferably includes signal processing means designed to filter the reflected wave signals or other noise from the upwards traveling modulated wave signals.

In a preferred embodiment the carrier waveform (the waveform before data modulation) is a single frequency sine wave or at least a narrow-band wave with 90% of the energy falling within boundaries defined by +/−10 percent deviation from the nominal center frequency. The waveform is preferably a sinusoidal wave. The nominal frequency of the waveform may range from 0.1 Hz to 100 Hz, depending upon the data rate requirement, the size of the liquid filled wave-guide tube, depth, and other parameters. For stimulation applications the frequency range may cover 1 to 100 Hz, preferably 1 to 10 Hz.

The generator of the waveform is an efficient electro-mechanical or, more specifically an electro-dynamic transducer comprising electromagnetic coils or an electro-acoustic transducer or actuator comprising electro-active material, such as piezoelectric material, electro- or magneto-strictive material. The transducer may take the form of a stack of piezoelectric elements and may be combined with suitable mechanical amplifiers to increase the effective displacement of the actuator system.

In accordance with yet another aspect of the invention, there is provided a method of communicating digital data through a borehole employing the steps of establishing a column of liquid as acoustic channel through said borehole, said column having a cross-sectional area of 58 $cm^2$ or less; generating at the down-hole location an acoustic wave carrier signal within said acoustic channel using an electro-active transducer; modulating amplitude and/or phase of said carrier wave in response to a digital signal; and detecting at the surface the modulated acoustic waves traveling within said acoustic channel.

In a preferred variant of the inventive method, the acoustic channel is established by lowering a liquid-filled coiled tubing string of the appropriate diameter of 3 inch or less, preferably 2.5 inch or less, or even 2 inch or less into the borehole.

Further aspects of the invention include the use of the above apparatus and methods in a well stimulation operation, such as fracturing or acidizing.

These and other aspects of the invention will be apparent from the following detailed description of non-limitative examples and drawings.

EXAMPLES

Figure 1A:
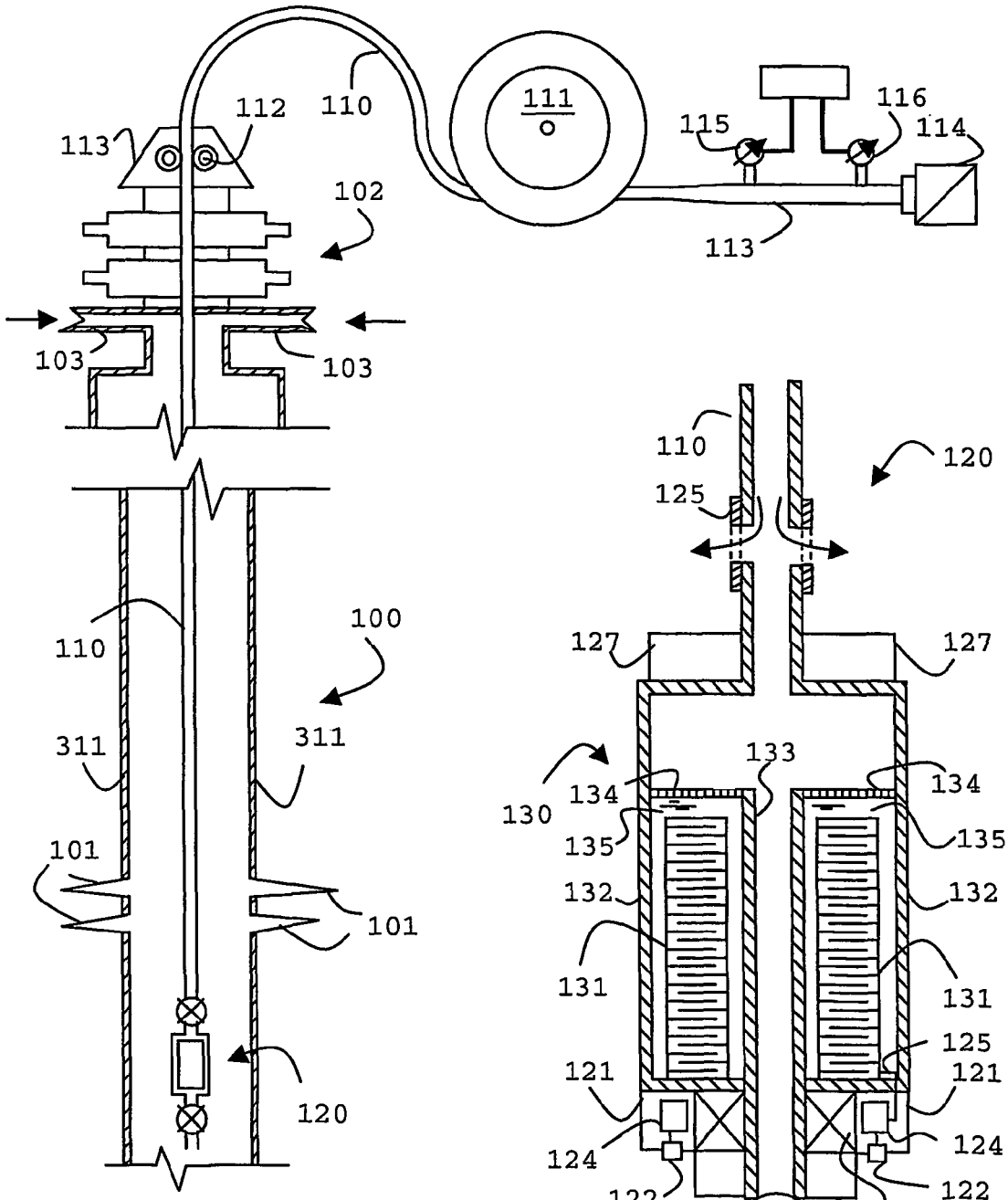
FIGS. 1A,B illustrate elements of an acoustic telemetry system in accordance with an example of the invention using coiled tubing as acoustic channel.

A first example of the invention is shown in FIG. 1A which depicts an example of the novel telemetry system in a well 100 during a well stimulation operation.

Prior to performing the stimulation, a down-hole measurement and telemetry sub 120 is mounted on a coiled tubing 110 to be positioned below perforations 101.

Coiled tubing system 110 includes a tubing reel 111 and a tubing feeder 112, which is mounted on a support frame 113. Feeder 112 pushes the tubing into well 100 through a well head 102, which is part of the surface installation. The surface end of coiled tubing 110 is connected to a liquid pump 114 through an instrumented pipe section 113, on which a number of pressure/acoustic transducers 115, 116 are mounted.

Figure 1B:
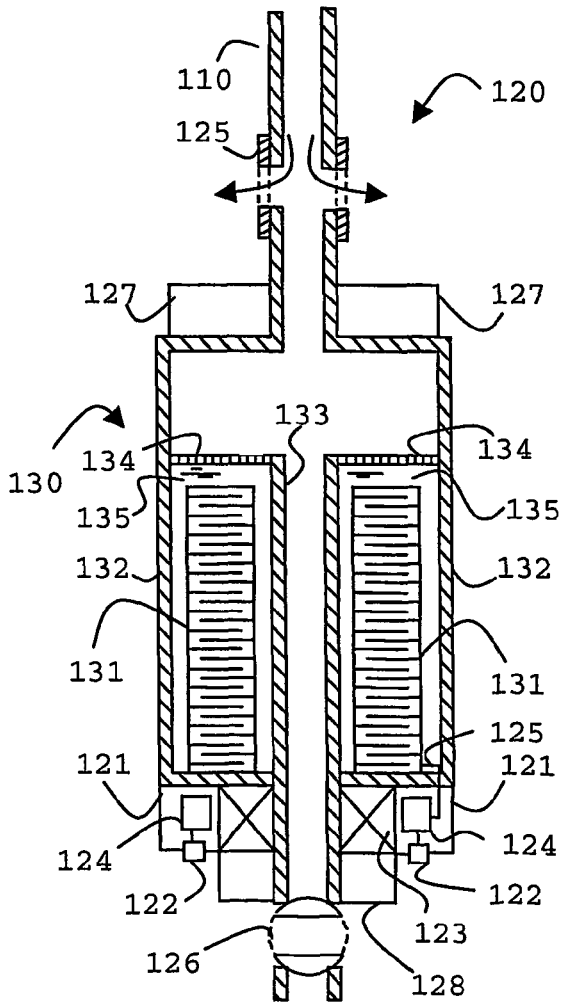

Down-hole measurement and telemetry sub 120 which is shown in more detail in FIG. 1B includes a measurement unit 121 with various sensors 122 for recording down-hole pressure and temperature. It further includes a power supply unit 123 with batteries to provide power to the operation of the sub and further electronic circuits to condition and digitize any analog signal. A power modulator 124 encodes measured data into a modulated voltage signal carrying the digitized data for driving a pressure/acoustic wave source 130 through a cable 125.

Source 130 is an electro-mechanical transducer that converts an electrical driving power (voltage or current) into a mechanical displacement. It includes a piezoelectric stack 131 protected by a housing 132, an inner flow-through tube 133, pressure transparent membrane 134 and protection fluid (electrically insulating) 135.

The liquid flow through sub 120 is controlled by two valves 125, 126 and the associated driving systems 127, 128. Valve 125 is a sliding or rotating sleeve valve, which is installed above source 130. Its driving unit 127 is linked to electronics/sensor unit 121. Valve 126 is shown to be a full bore solenoid flow-through valve, which is installed below the sub.

Valves 125, 126 are operated so as to enable pumping cleaning fluid through coiled tubing 110 to clean up unwanted materials such as proppants after a stimulation operation. Additionally, valves 125, 126 facilitate filling up and pressurizing coiled tubing 110 with liquid, so that the attenuating effect of air trapped in the tubing is minimized and the channel established by the liquid in coiled tubing 110 is suitable for acoustic wave transmission.

Before a stimulation, liquid pump 114 pumps a low viscosity fluid such as water through coiled tubing 110 to fill it up, and pressurizing it to an appropriate pressure by continuing pumping after closing the down-hole valve 126.

During the stimulation operation, the stimulation fluid is pumped into the cased well bore 100 from a well head entry 103. The fluids flow into the formation through the perforations 101 above measurement/telemetry sub 120 deployed by coiled tubing 110. A blast joint (not shown) is mounted where the stimulation fluid first meets the coiled tubing to protect the coiled tubing from erosion. The down-hole measurement/telemetry sub 120 starts to record pressure, temperature and other data after the stimulation process begins. The data is then converted to a binary code, which modulates a sinusoidal or pulse voltage with one or a combination of the following modulation schemes: frequency shift keying (FSK), phase shift keying (PSK), amplitude shift keying (ASK) or various pulse modulation methods, e.g. pulse width or pulse position modulation.

In the example, modulation of sinusoidal waves with a digital method such as FSK or PSK is used. The modulated electrical signal is converted to a pressure/acoustic wave of same modulation by the down-hole electromechanical source 130.

The wave is detected by at least one, or more, pressure/acoustic transducers 115, 116 on the surface. The transducers are spatially separated by more than ⅛ of wavelength of the carrier wave. The spatial separation allows to apply various known techniques to improve the reception of the signal in the presence of noise and interference as caused for example by reflected waves.

The telemetry system shown in FIG. 1 can be made bi-directional by installing a pressure/acoustic transducer in the down-hole sub, and a pressure/acoustic wave source on surface.

The sensing element of the down-hole transducer is exposed only to the liquid inside the coiled tubing, and therefore insensitive to the stimulation pressure outside the tubing. The surface source can be built similar to the design of the down-hole source, however the power required to operate it can be supplied from an external source.

To perform a surface to down-hole down communication, the surface source sends out a signal in a frequency band that is outside the frequency band of the upward telemetry. Therefore the two-way communication can be performed simultaneously without interfering with each other. A bi-directional telemetry system is relevant if during the operation, the operational modes of down-hole devices, such as sampling rate, telemetry data rate, are to be altered. Other functions unrelated to altering measurement and telemetry modes may include opening or closing certain down-hole valves or enable/disable the down-hole source.

Alternatively to the deployment on a coiled tubing the communication system of the present invention may be used in conjunction with hydraulic control lines. Modern wells are often completed with production tubing, down-hole sensors for permanent monitoring and down-hole control devices such as valves. In such completions often at least one hydraulic control line is deployed with the production tubing. Provided the line has a diameter that renders it useful for the application of the invention, e.g. with a ¼ inch (nominal size of the inner diameter) diameter tubes, it can provide a channel for pressure signal communication between a down-hole transmitter and a surface controller.

In normal practice of so-called "intelligent" completion, electrical cables are used to provide the communication link between any down-hole sensors and surface data acquisition system. The cables also provide electrical power to the down-hole sensors. However as the installation of cables and pipes alongside the production tubing is difficult, a telemetry system based on a hydraulic line, as proposed herein, can be advantageous as it alleviates the need to install additional electrical cables.

Figure 2:
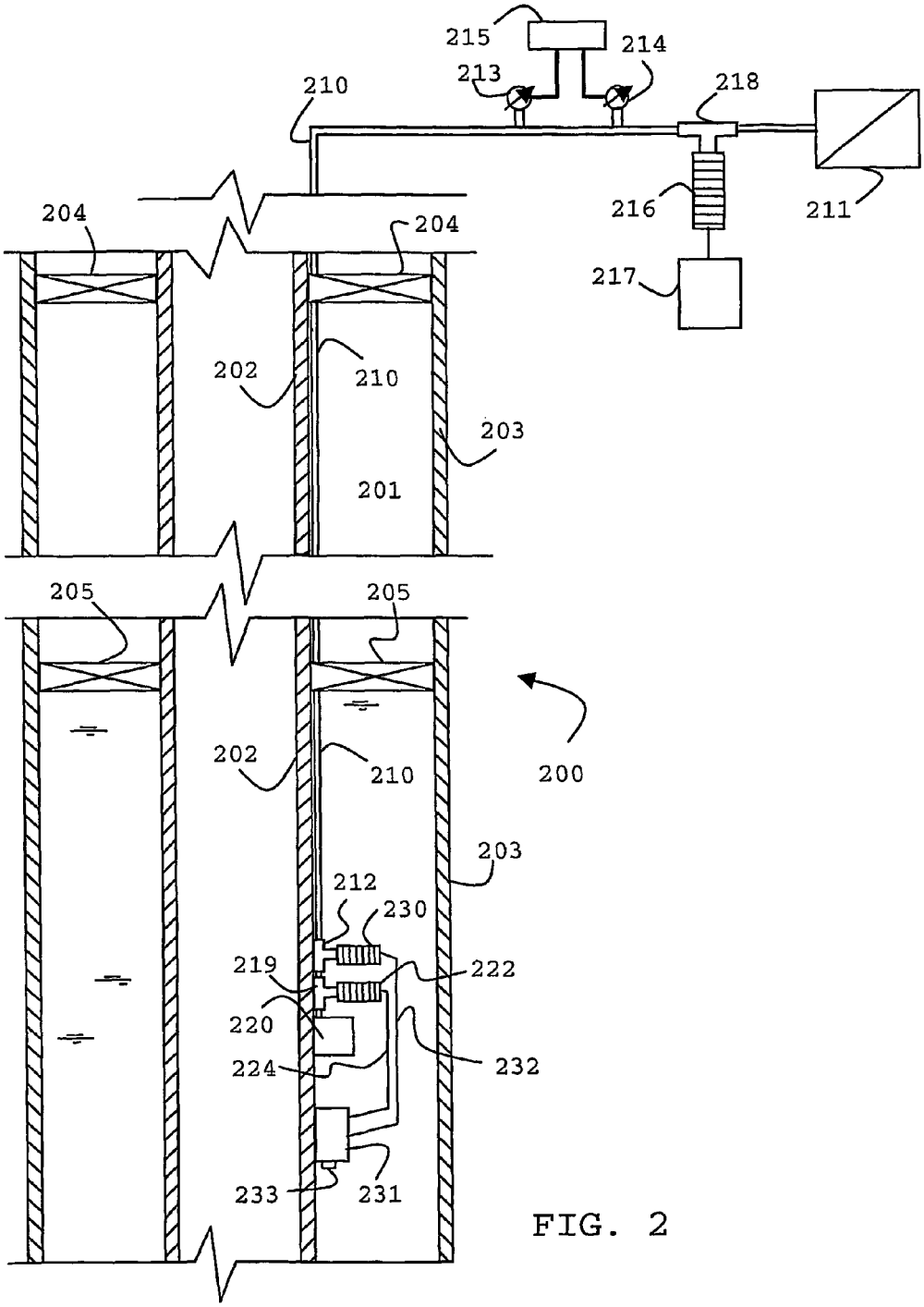
FIG. 2 shows elements of an alternative embodiment of the novel telemetry system using a hydraulic power line as acoustic channel.

FIG. 2 shows an arrangement of a system utilizing a permanently installed hydraulic control line as an acoustic telemetry channel for monitoring down-hole parameters of a producing well 200. FIG. 2 illustrates schematically the side wall of well 200 along which a hydraulic line 210 linking a surface hydraulic controller 211 to a down-hole valve 220. To enable hydraulic pressure transmission, line 210 is filled with a hydraulic liquid.

Operation commands, in the form of pressure signals, are generated on surface by controller 211 and transmitted to down-hole actuator/valve 220 via hydraulic control line 210. Control line 210 can normally be deployed through various sealing devices in the annulus 201 between production tubing 202 and casing 203. The sealing devices may include a surface seal 204 and a number of down-hole packers 205.

Whereas the above-described parts of the installation are known per se, it is seen as a feature of this example of the invention that control line 210 is made hydraulically accessible to a pressure wave source 230 based on an electromechanical device, such as a piston driven by a piezoelectric stack. In the present example, hydraulic access is provided by a T-type pipe joint 212. Pressure source 230 is connected to a down-hole telemetry unit 231 via a cable 232. Measurement data from various down-hole sensors 233 can be sent to telemetry unit 231 via multiple cables (electrical or optical), or via a single cable that serves as a data bus. Telemetry unit 231 encodes the data and provides a carrier signal wave with the appropriate modulation for transmission of the digital data, e.g. binary frequency or phase modulation. The unit 231 also provides power amplification to the modulated signal before the amplified signal is then applied to pressure wave source 230. The data-carrying pressure wave propagates through the liquid in hydraulic line 210 to the surface. One or more pressure transducers 213, 214 mounted on hydraulic line 210 detect the modulated carrier wave on the surface. A surface signal processor or demodulator 215 receives the pressure signals from transducers 213, 214 and demodulates them to recover the transmitted data.

As in the previous example, the down-hole sensors and electronics for measurement and telemetry can be battery powered. However in a permanent down-hole installation, the life span of a down-hole battery may not be sufficient for long term monitoring applications. In a variant of this example it is therefore proposed to generate electric power down-hole by using pressure waves generated on surface.

As shown in FIG. 2, a pressure wave source 216, which may be a piezoelectric piston source driven by a sinusoidal wave generated in an electrical power supply 217, is mounted on the surface section of the hydraulic control line via a T-type pipe junction 218. This source can generate pressure wave at frequencies higher that those generated by hydraulic controller 211. Several hundred Watts of acoustic power may be generated by surface source 216. Even after taking into consideration a propagation attenuation of several dB/kft, there will be 1-10 Watts acoustic power available down-hole at the end of a, for example, 10 kft or 3300 meter borehole. This acoustic power can be converted to electrical power by a piezoelectric converter 222, mounted on a down-hole section of hydraulic control line 210 via a T junction 219. The converted electrical current flows into an energy storage unit 223 via a cable 224. Storage unit 223, which may be a capacitor bank, supplies electrical power to the down-hole sensors and to the telemetry unit 231.

In a typical permanent monitoring operation, the frequency at which down-hole data are acquired and transmitted is low, amounting to the transmission of a batch of data once or twice per hour. Therefore energy accumulated during the long idle intervals should be sufficient to power the down-hole devices during the infrequent active intervals. Operations exists for which a single down-hole pressure source 230 is sufficient for use as both, data transmitter to transmit measured data to the surface and electrical power converter for the acoustic power sent from surface.

The configuration of FIG. 2 also facilitates a two-way telemetry system. In a two-way telemetry set-up surface source 216 is used to send down-link commands, in the form of digitally coded pressure waves, to down-hole devices, in order to change their operation modes. Either single down-hole pressure source 230 or, alternatively, piezoelectric converter 222 may be used as down-hole receiving transducers. Appropriate signal-processing/demodulation functions can be built into down-hole telemetry unit 231 to decode the commands.

To avoid cross-interferences between the hydraulic control system, the up-link telemetry system, the down-link telemetry system and the power generation system, wave frequencies are separated. For instance, the frequency of the hydraulic control signal may be below 0.5 Hz, the up-link telemetry frequency may be between 1 Hz to 3 Hz, the down-link telemetry band may occupy the next frequency band from 3 to 5 Hz and the power generation frequency may be around 7 Hz. If these different systems can be operated at different time intervals, they may time-share a one or more common frequency band.

In FIGS. 3 A, B, there is shown a simulated example to illustrate the working of the new telemetry system through thin tubes.

Figure 3A:
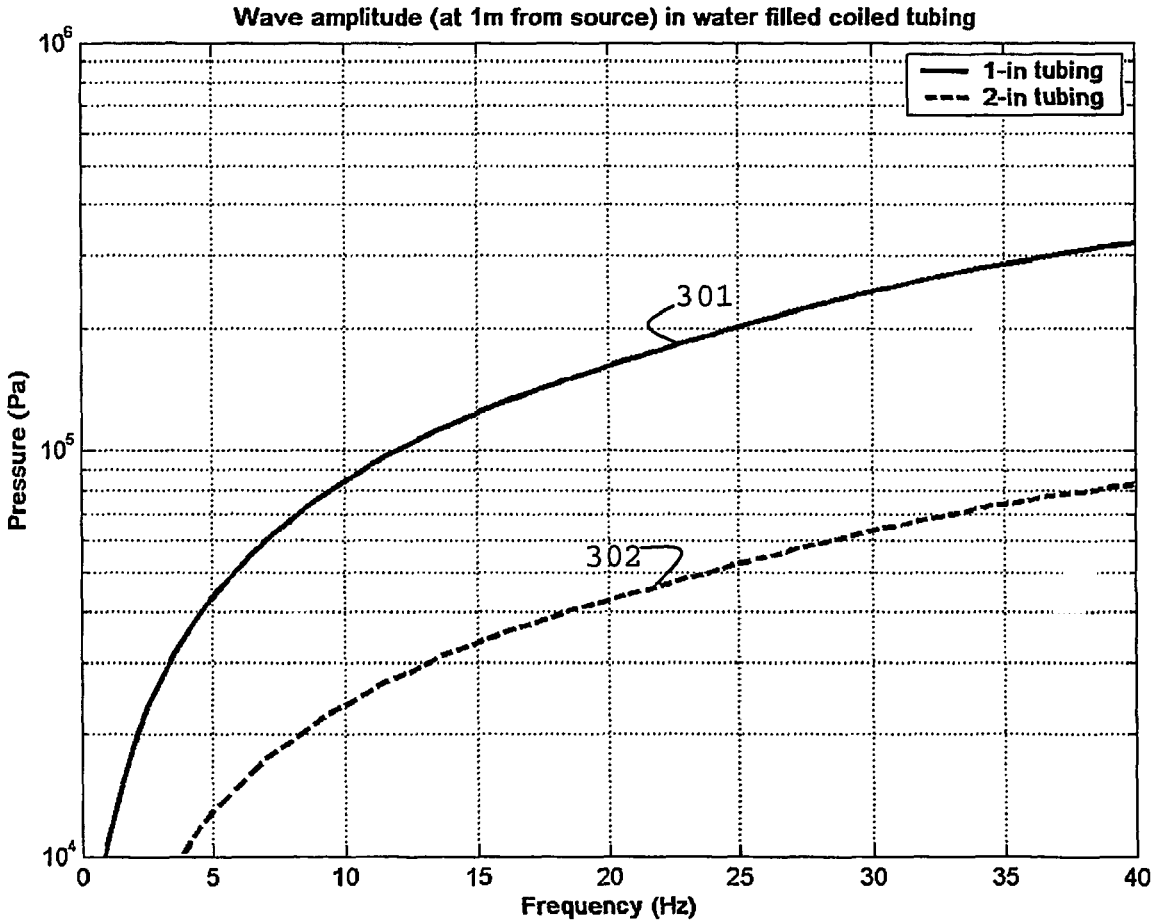
FIGS. 3A,B show simulated signal power and power loss spectra.

FIG. 3A shows the simulated amplitude versus source frequency for a peak-to-peak displacement of 0.3 mm generated by a piston of 2.5 inch diameter generating pressure waves in a water filled tube. The upper solid curve 301 represents the case of a 1 inch inner diameter tube and the lower dashed curve 302 represents a 2-inch tube. The amplitude is measured in Pa and the frequency in Hz. The amplitude in the larger tube is significantly lower. The acoustic power produced by such a system is around 2 W at 30 Hz. Assuming a source efficiency of 0.25, the electrical power required to generate the wave signal is less than 10 W, and, hence, within the limits of the amount of power that can be stored or generated at a down-hole location.

Figure 3B:
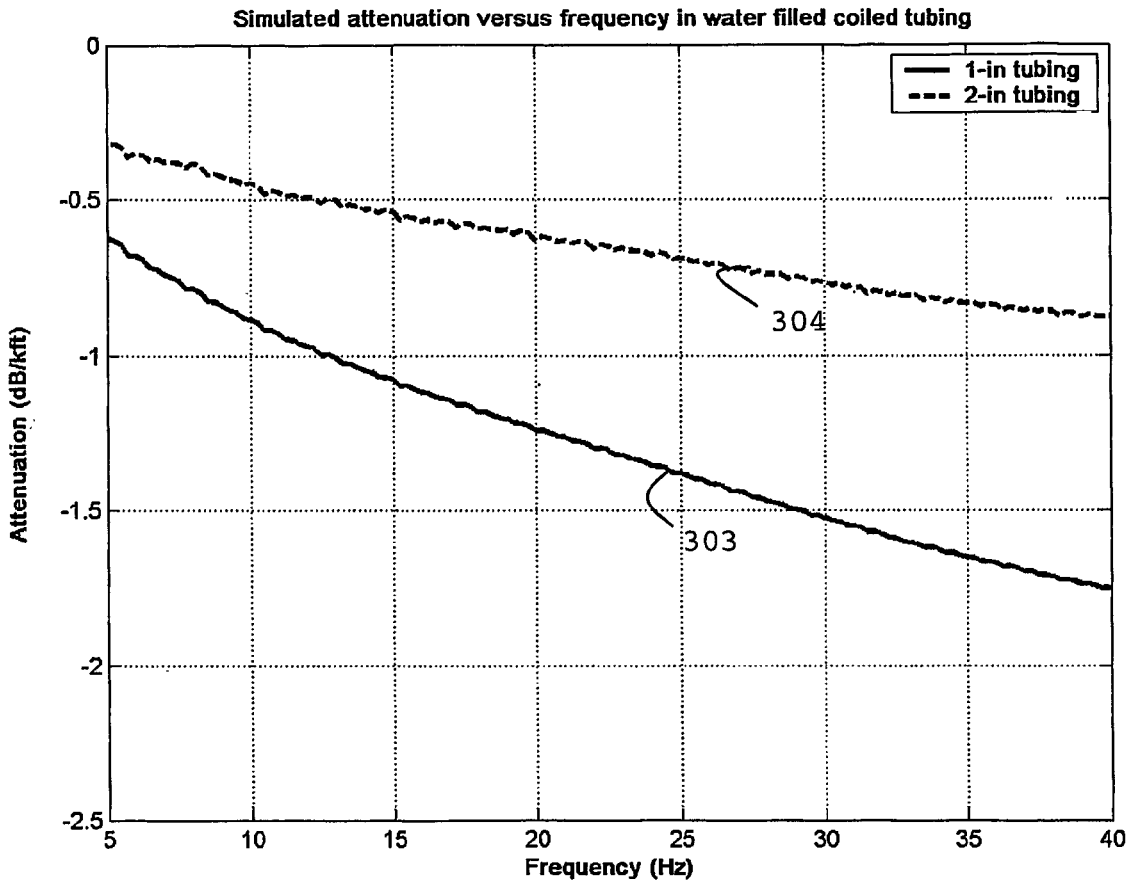
Figure 4:
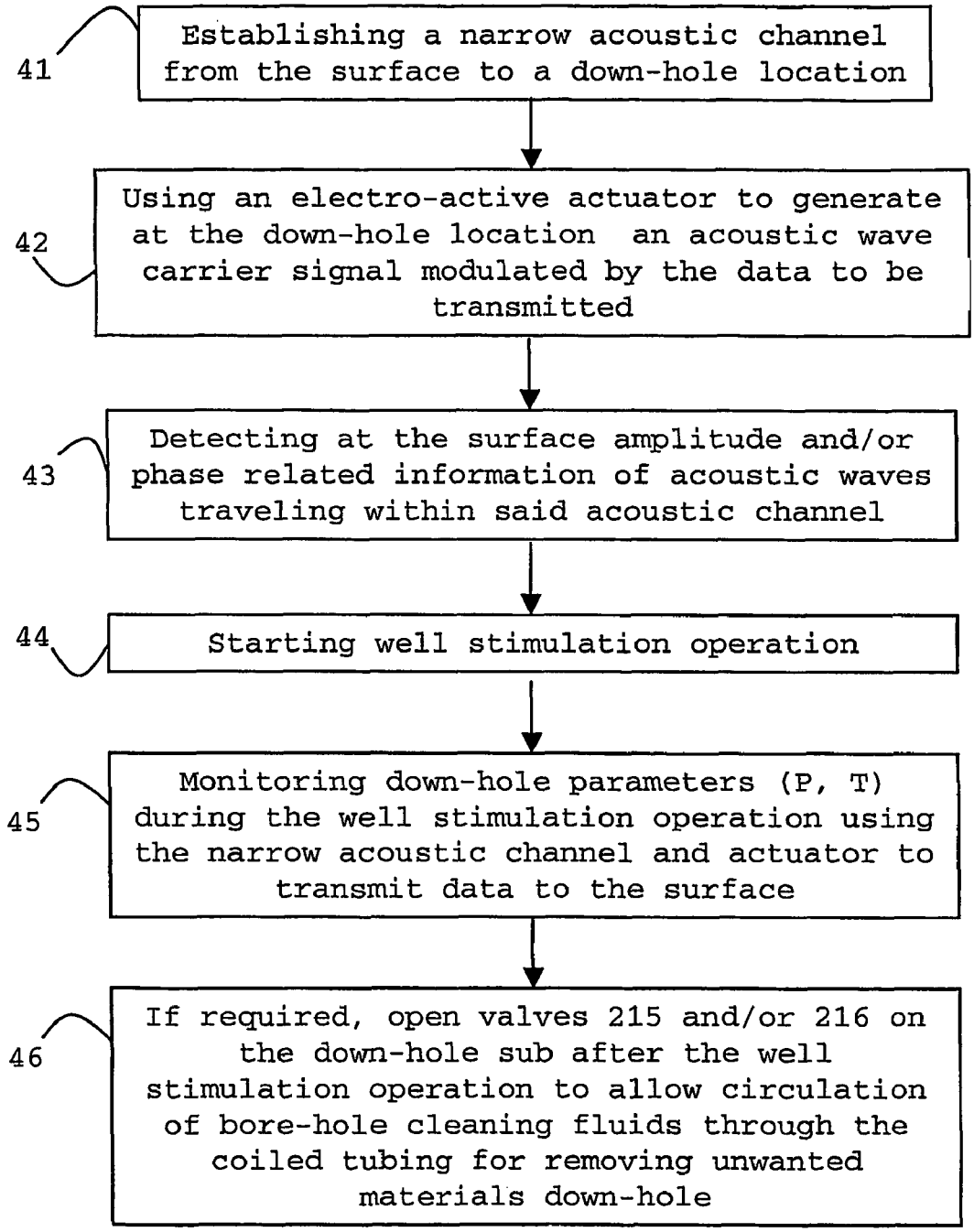
FIG. 4 is a flows diagram illustrating steps of a well stimulation method in accordance with the invention.

FIG. 3B shows the simulated attenuation coefficients in decibels (dB) per 1000 ft versus frequency for coiled tubing with 1-inch (solid curve 303) and 2-inch (dashed curve 304) inner diameters. As the diameter decreases the attenuation increases leading to a higher attenuation in the 1-inch tubing. However with a wave amplitude of 30 psi is generated at 25 Hz in a 1" tubing, a loss of 15 dB over a depth of 10000 feet would provide more than 5 psi signal amplitude on surface.

The attenuation can be high for very thin tubes such as a ½-inch hydraulic control line (3 mm inner diameter). However, for a low data rate application in a low noise environment, such as well monitoring, a very low frequency at around 1-5 Hz may be used to reduce attenuation. Since the tube is thin, high signal amplitude can be generated even at low frequencies (as demonstrated in FIG. 3A), thus sufficient signal to noise ratio can be achieved on the surface.

The above apparatus and method is particularly advantageous when applied to a well stimulation operation such as acidizing or fracturing. For these operations it is often desirable to have a flexible and readily deployable method of measuring data at a predetermined location in the well and transmitting the measured data to a surface location. If for example an existing well requires stimulation, the operation can be started as illustrated by FIG. 5 by first lowering from the surface a small-diameter coiled tubing with the measurement and telemetry sub as described in FIG. 1. When the sub reaches the target depth, an acoustic channel is established in step 41 by filling the coiled tubing with water or any other low-loss liquid. The acoustic source is activated in the following step 42 and measured data such as temperature and pressure are encoded and transmitted as a modulated wave signal to the surface receivers where it is demodulated and filtered to recover the original data (step 43).

In a fracturing operation the operator can then start pumping the fracturing fluids and proppants as required from the surface (step 44). It will be appreciated that the acoustic channel through the coiled tubing is not affected by the stimulation operation and can continue to be used as telemetry system to monitor the down-hole conditions during the whole and after completing the stimulation (step 45).

In a final step of the operation the coiled tubing is retrieved.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An acoustic telemetry apparatus for communicating digital data from a down-hole location through a borehole to the surface or between locations within the borehole, said apparatus comprising a receiver and a transmitter separated by an acoustic channel wherein the acoustic channel has a cross-sectional area of 58 $cm^2$ or less and is a column of a low-loss acoustic liquid extending within the borehole and the transmitter comprises an electro-active transducer generating a modulated continuous waveform.

2. The acoustic telemetry apparatus of claim 1 wherein the waveform is modulated to transmit the data.

3. The acoustic telemetry apparatus of claim 1 wherein the waveform is modulated to transmit encoded data comprising the results of a plurality of different types of measurements.

4. The acoustic telemetry apparatus of claim 1 wherein the cross-sectional diameter of the acoustic channel is 25 $cm^2$ or less.

5. The acoustic telemetry apparatus of claim 1 wherein the column of liquid extends from the surface to a down-hole location.

6. The acoustic telemetry apparatus of claim 5 wherein the acoustic channel is a continuous liquid-filled tubing string temporarily suspended in the borehole.

7. The apparatus of claim 5 wherein the acoustic channel is a tubular control line permanently or quasi-permanently installed in the borehole.

8. The apparatus of claim 7 wherein the acoustic channel is a tubular control line permanently or quasi-permanently installed in the well bore providing simultaneously hydraulic control to a down-hole installation.

9. The acoustic telemetry apparatus of claim 1 wherein the low-loss acoustic liquid has a viscosity of less than $3\times10^{-3}$ $NS/m^2$.

10. The acoustic telemetry apparatus of claim 1 further comprising an acoustic source installed at the surface and a receiver installed at the down-hole location to enable two-way communication through the acoustic channel.

11. The acoustic telemetry apparatus of claim 1 further comprising a signal processing device adapted to filter the reflected wave signals or other noise from the upwards traveling modulated wave signals.

12. The acoustic telemetry apparatus of claim 1 wherein the waveform has narrow-band of less than +/−10 percent half-width deviation from a nominal frequency.

13. The acoustic telemetry apparatus of claim 1 wherein the waveform is a sinusoidal wave.

14. The acoustic telemetry apparatus of claim 1 wherein the transducer comprises piezo-electric material.

15. A method of communicating digital data from a down-hole location through a borehole to the surface comprising the steps of:

establishing a column of low-loss acoustic liquid as acoustic channel through said borehole, said column having a cross-sectional area of 58 $cm^2$ or less;

generating at the down-hole location an acoustic wave carrier signal within said acoustic channel using an electro-active transducer;

modulating amplitude and/or phase of said carrier wave in response to a digital signal; and detecting at the surface the modulated acoustic waves traveling within said acoustic channel.

16. The method of claim 15 further comprising the steps of performing measurements of down-hole parameters, encoding said measurements into a bitstream; and controlling the transducer in response to said encoded bitstream.

17. The method of claim 15 further comprising the step of selecting the frequency of the carrier wave in the range of 0.1 to 100 Hz.

18. A method of stimulating a wellbore comprising the steps of performing operations designed to improve the production of said wellbore while simultaneously establishing from the surface to a down-hole location a column of low-loss acoustic liquid as acoustic channel through said borehole;

generating at the down-hole location an acoustic wave carrier signal within said acoustic channel using an electro-active transducer;

modulating amplitude and/or phase of said carrier wave in response to a digital signal; and detecting at the surface the modulated acoustic waves traveling within said acoustic channel.

19. The method of claim 18 wherein the step of establishing from the surface to a down-hole location a column of liquid as acoustic channel comprises the step of lowering a coiled tubing string into the borehole, the coiled tubing string defining a cross-sectional area of 58 $cm^2$ or less.

20. An acoustic telemetry apparatus for digitally communicating from the surface to a down-hole location through a borehole, said apparatus comprising an acoustic source installed at the surface separated by an acoustic channel from a receiver installed at the down-hole location, wherein the acoustic channel has a cross-sectional area of 58 $cm^2$ or less and is a column of low-loss acoustic liquid extending within the borehole, and the acoustic source comprises an electro-active transducer generating a modulated continuous waveform.

21. The acoustic telemetry apparatus of claim 20, wherein the acoustic source provides operational commands to the down-hole receiver.

22. The acoustic telemetry apparatus of claim 20 wherein the cross-sectional diameter of the acoustic channel is 25 $cm^2$ or less.

23. The acoustic telemetry apparatus of claim 20, wherein the acoustic channel is a continuous liquid-filled tubing string temporarily suspended in the borehole.

24. The acoustic telemetry apparatus of claim 20, wherein the acoustic channel is a tubular control line permanently or quasi-permanently installed in the borehole.

25. The acoustic telemetry apparatus of claim 24 wherein the acoustic channel is a tubular control line permanently or quasi-permanently installed in the well bore providing simultaneously hydraulic control to a down-hole installation.

26. The acoustic telemetry apparatus of claim 20 wherein the column of low-loss acoustic liquid has a viscosity of less than $3\times10^{-3}$ $NS/M^2$.

27. The acoustic telemetry apparatus of claim 20, further comprising a down-hole transmitter and a surface receiver separated by the acoustic channel, wherein the down-hole transmitter is adapted for digital communication with the surface receiver.

28. The acoustic telemetry apparatus of claim 27, wherein the acoustic source installed at the surface communicates with the down-hole receiver in a frequency band that is outside the frequency band of the communication from the down-hole transmitter with the surface receiver.

29. The apparatus of claim 8 wherein the downhole installation comprises a valve.

30. An acoustic telemetry apparatus for communicating digital data from a down-hole location through a borehole to the surface or between locations within the borehole, said apparatus comprising a receiver and a transmitter separated by an acoustic channel wherein the acoustic channel is a tubular control line installed in the well bore and providing hydraulic control to a down-hole installation which comprises a valve and the transmitter comprises an electro-active transducer generating a modulated continuous waveform.

31. The method of claim 15 wherein the low-loss acoustic liquid has a viscosity of less than $3\times10^{-3}$ $NS/m^2$.

32. The method of claim 18 wherein the low-loss acoustic liquid has a viscosity of less than $3\times10^{-3}$ $NS/m^2$.

33. The method of claim 18 wherein said operations to improve production of the wellbore comprise delivering a fluid into the wellbore to flow into the formation surrounding the wellbore.

34. A process for improving production of a wellbore including a step of delivering a fluid into the wellbore to flow into the formation surrounding the wellbore, wherein the process includes establishing a column of liquid as an acoustic channel through said borehole, said column having a cross-sectional area of 58 $cm^2$ or less and the liquid having viscosity of less than $3\times10^{-3}$ $NS/m^2$; and communicating digital data from a down-hole location to the surface by generating at the down-hole location an acoustic wave carrier signal within said acoustic channel using an electro-active transducer, modulating amplitude and/or phase of said carrier wave in response to a digital signal; and detecting at the surface the modulated acoustic waves traveling within said acoustic channel.

* * * * *